US005207273A

United States Patent [19]

Cates et al.

[11] Patent Number: 5,207,273

[45] Date of Patent: May 4, 1993

[54] METHOD AND APPARATUS FOR PUMPING WELLS

[75] Inventors: Gordon O. Cates; Ronald M. Bass, both of Houston; Kenneth J. Schmitt, Spring, all of Tex.

[73] Assignee: Production Technologies International Inc., Houston, Tex.

[21] Appl. No.: 583,828

[22] Filed: Sep. 17, 1990

[51] Int. Cl.[5] ..... E21B 43/00

[52] U.S. Cl. ..... 166/369; 166/65.1; 166/66.4; 166/68; 166/106; 417/423.3

[58] Field of Search ..... 166/66.4, 65.1, 68, 166/105, 106, 369; 417/423.3

[56] References Cited

U.S. PATENT DOCUMENTS

| | | | |
|---|---|---|---|
| 3,672,795 | 6/1972 | Arutunoff et al. | 417/424 |
| 3,853,430 | 12/1974 | O'Rourke | 417/360 |
| 4,627,490 | 12/1986 | Moore | 166/65.1 |
| 4,716,960 | 1/1988 | Eastlund et al. | 166/60 |
| 4,749,034 | 6/1988 | Vandevier et al. | 166/68 X |
| 4,798,247 | 1/1989 | Deaton et al. | 166/66.4 |
| 4,886,114 | 12/1989 | Perkins et al. | 166/66.4 X |
| 4,901,070 | 2/1990 | Vandevier | 166/66.4 X |
| 4,913,239 | 4/1990 | Bayh, III | 166/66.4 X |
| 4,928,771 | 5/1990 | Vandevier | 166/385 |

*Primary Examiner*—Hoang C. Dang
*Attorney, Agent, or Firm*—M. H. Gay

[57] ABSTRACT

A method and apparatus for producing wells in which the tubing and casing are used as electrical conduits for a centrifugal pump in the well and single phase A. C. or D. C. current is supplied to the well and converted to three phase current at the pump motor.

10 Claims, 4 Drawing Sheets

METHOD AND APPARATUS FOR PUMPING WELLS

This invention relates to method and apparatus for pumping wells and more particularly to powering a three phase motor in the well from a source of single phase AC or DC current at the surface and converting the source current to three phase at the motor.

The patent literature teaches the use of a well tubing and casing as current paths for A. C. current to heat the tubing to counter paraffin buildup. See for example U.S. Pat. No. 4,716,960. This patent also teaches the use of the tubing and casing to provide single phase A. C. power to a down hole motor. Three phase electric motors are preferred for down hole pumps. They have been used in the past by running three conduits from the surface down to the motor.

An object of this invention is to supply single phase A. C. or D. C. current down hole and convert the current to three phase current in the well at the motor.

Another object of this invention is to provide a method and apparatus for supplying a single current such as single phase A. C. or D. C. current to a well through the casing and through a means for running a pump and motor into a well such as suspending the pump and motor on a tubing and running the tubing into a well and using the tubing as a conduit; and converting the current to three phase current at the motor.

Another object is to provide a method and apparatus as in the preceding object in which the well is packed off at the motor and the annulus above the packer is filled with nonconducting fluid.

Another object is to provide a method and apparatus for supplying a single current to a well through the casing and through a means for running a pump and motor in which the means for running the pump and motor is covered with insulation material at least up to the level of well fluids in the well.

Other objects, features and advantages of this invention will be apparent from the specification, drawings and claims.

In the drawings wherein illustrative embodiments of this invention are shown and wherein like reference numerals indicate like parts:

Figure 1:
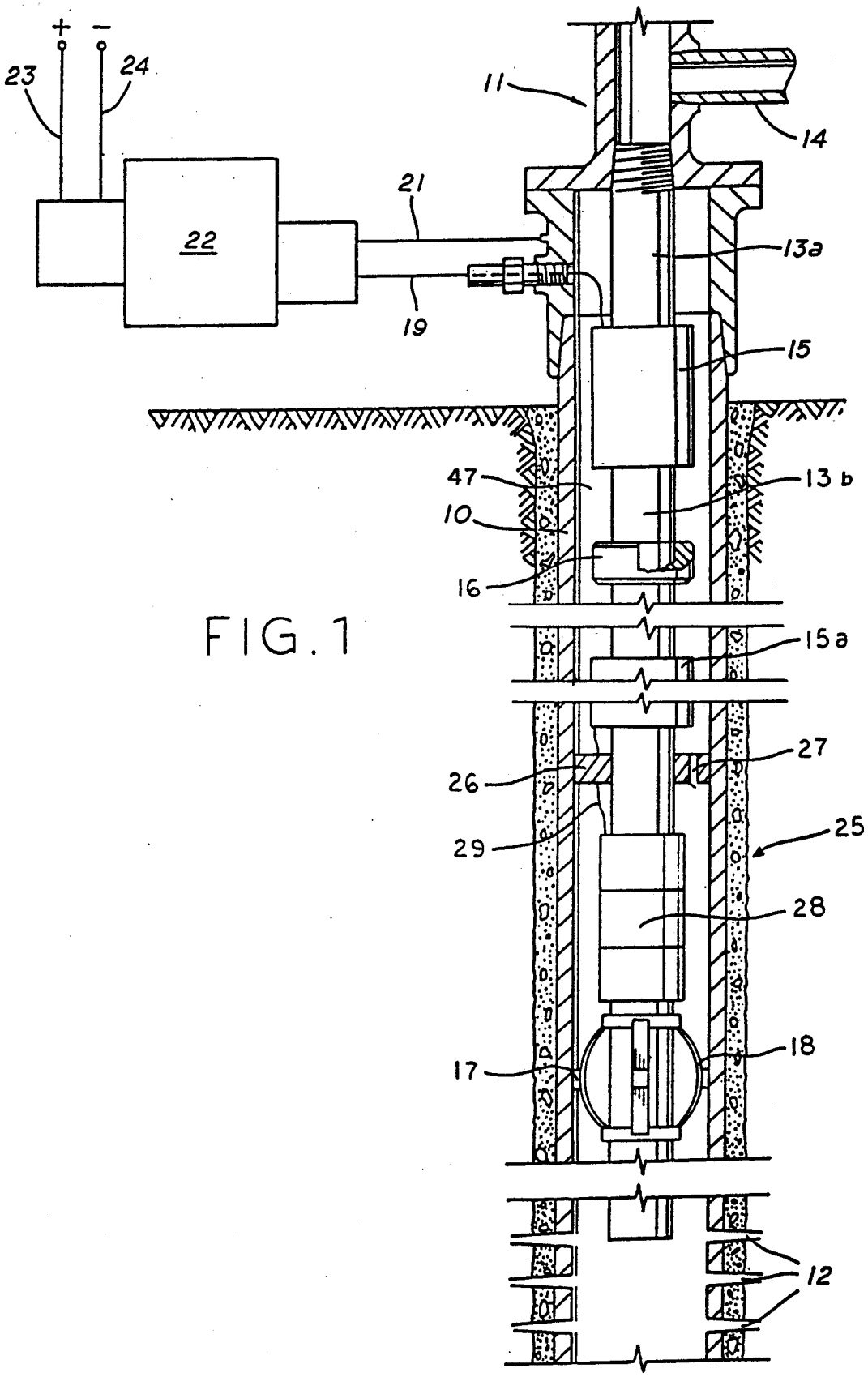
FIG. 1 is a schematic view partly in section and partly in elevation illustrating a form of this invention.

Referring first to FIG. 1 a petroleum well is shown to include a casing 10 in the well bore and secured to a wellhead indicated generally at 11. As is conventional the casing and wellhead are formed of electrically conducting material such as steel. At the lower end of the casing perforations 12 admit fluid from the formation into the well bore.

A tubing having an upper section **13*a* and a lower section 13*b* is suspended in the casing and conveys well fluid to the surface and out through the pipe 14** to the gathering system of the field in which the well is located.

The upper and lower sections of the tubing are connected by an insulating collar 15 which electrically insulates the two tubing sections from each other while mechanically connecting the two sections, The upper and lower tubing sections are formed of electrically conducting material such as conventional steel. Suitable collars are shown in U.S. Pat. Nos. 4,861,074 and 4,716,960. The disclosures of these patents are incorporated herein in their entireties. While the tubing may be insulated from the casing, the insulating collar 15 omitted and current applied to the tubing at the wellhead as taught in the prior art this is not preferred as it results in a "hot" wellhead.

Below the insulating collar 15 the tubing **13*b* is electrically insulated from the casing by a plurality of insulating spacers 16** which are carried on the exterior of the tubing and space the tubing from the casing. These spacers are of insulating material such as plastic and are spaced at intervals along the tubing as needed, such as on each joint of tubing, to insulate the tubing from the casing.

At the surface a source of power 22 is provided. This source of power has one lead 19 which extends through the wall of the casing and is connected to the tubing **13*b* in any desired manner. In FIG. 1 this lead 19 is shown to connect to insulating collar 15. The other lead 21 from the power source is connected to the wellhead at any convenient point. The source 22 may receive power from lines 23 and 24** or may be a power generator.

In accordance with this invention the power source provides a "single current". This term "single current" as used herein means either single phase alternating current (A. C.) or direct current (D. C.).

In accordance with this invention the tubing provides a means for conducting current down hole and for suspending and running an assembly indicated generally at 25 on its lower end for lifting well fluid to the surface. As is well known conventional tubing will have sufficient strength to support a pump and motor assembly at the lower end of the tubing. The insulating collars 15 will also have sufficient strength to support the pump and motor assembly.

The assembly 25 may include an insulating collar such as a second insulating collar **15*a* provided in the tubing adjacent the lower end of the tubing. Depending from this collar may be a packer 26 for packing off between the casing and tubing. A check valve 27** in the packer provides for displacing any well fluids above the packer with nonconductive fluids such as oil or gas.

The assembly will include a subassembly 28 of a motor, centrifugal pump and means for converting the single A. C. current to three phase current or inverting the single D. C. current to three phase A. C. current. Current will be conducted from the collar **15*a* to the subassembly 28 in any desired manner as indicated schematically by the insulated conduit 29 which extends from the collar 15*a* through the packer 26 to the subassembly 28. The circuit between the tubing 13*a*–13*b* and casing 10 is completed by the scratcher 18 which is of conventional design and the contact blocks 17**.

Figures 2, 3, 4:
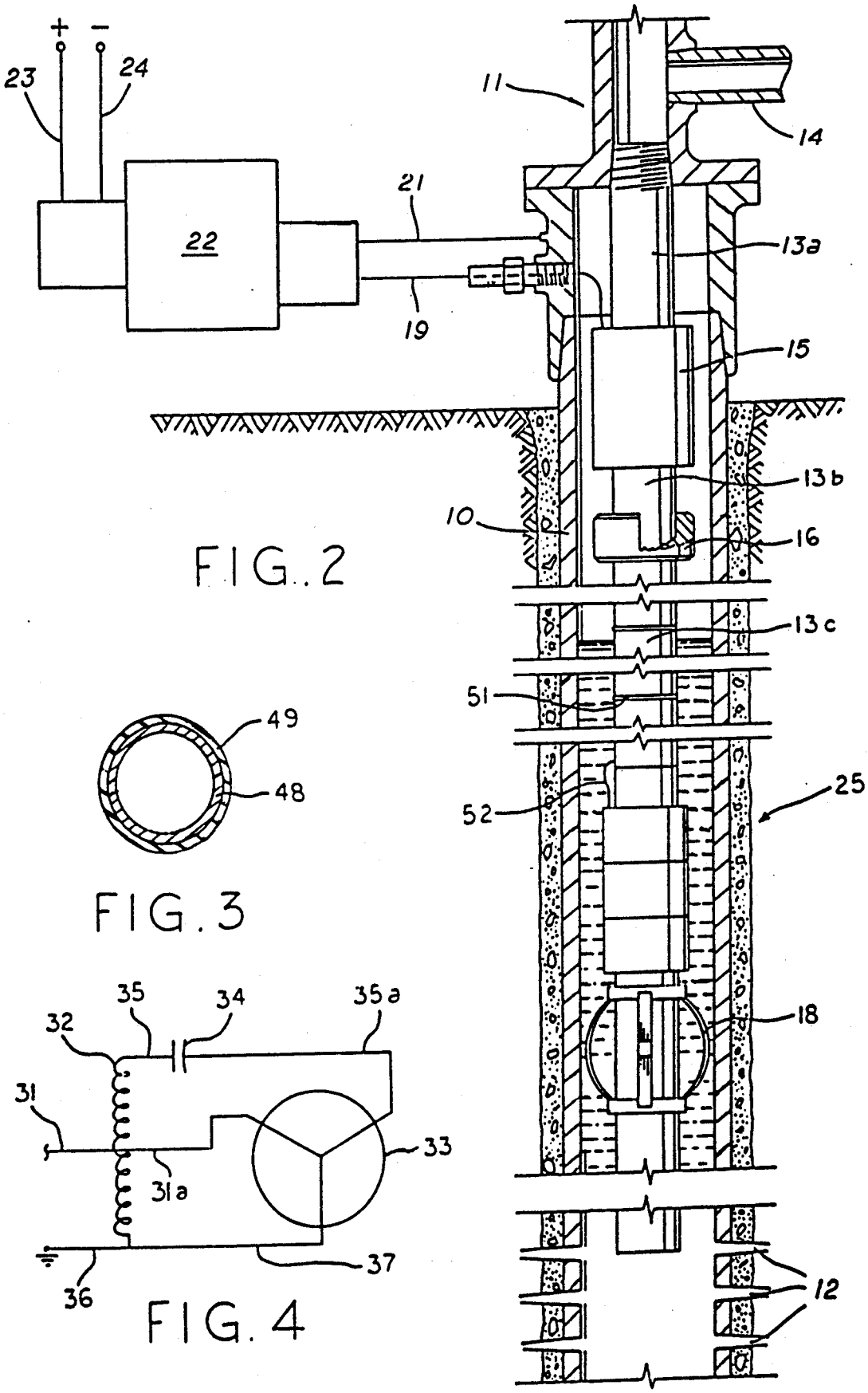
FIG. 2 is a view similar to FIG. 1 illustrating a modified form of this invention.
FIG. 3 is a sectional view through the tubing of FIG. 2 at a depth below the top of the well fluid.
FIG. 4 is a schematic of a phase converter for converting a single A. C. current to three phase current.

FIG. 4 illustrates a phase converter for converting a single phase A. C. current to three phase current. These converters are well known to those skilled in the art. The current from the tubing is connected through conductor 31 to the center tap of transformer 32 and through conductor **31*a* to the motor 33. One leg of the transformer is connected by conduit 35 to capacitor means 34 which is connected by conductor 35a to motor 33. The other leg of the transformer is connected to ground 36 as is the motor through conductor 37. Ground is provided by connecting the converter to the casing 10 through scratcher 18 and contact blocks 17**.

Figure 5:
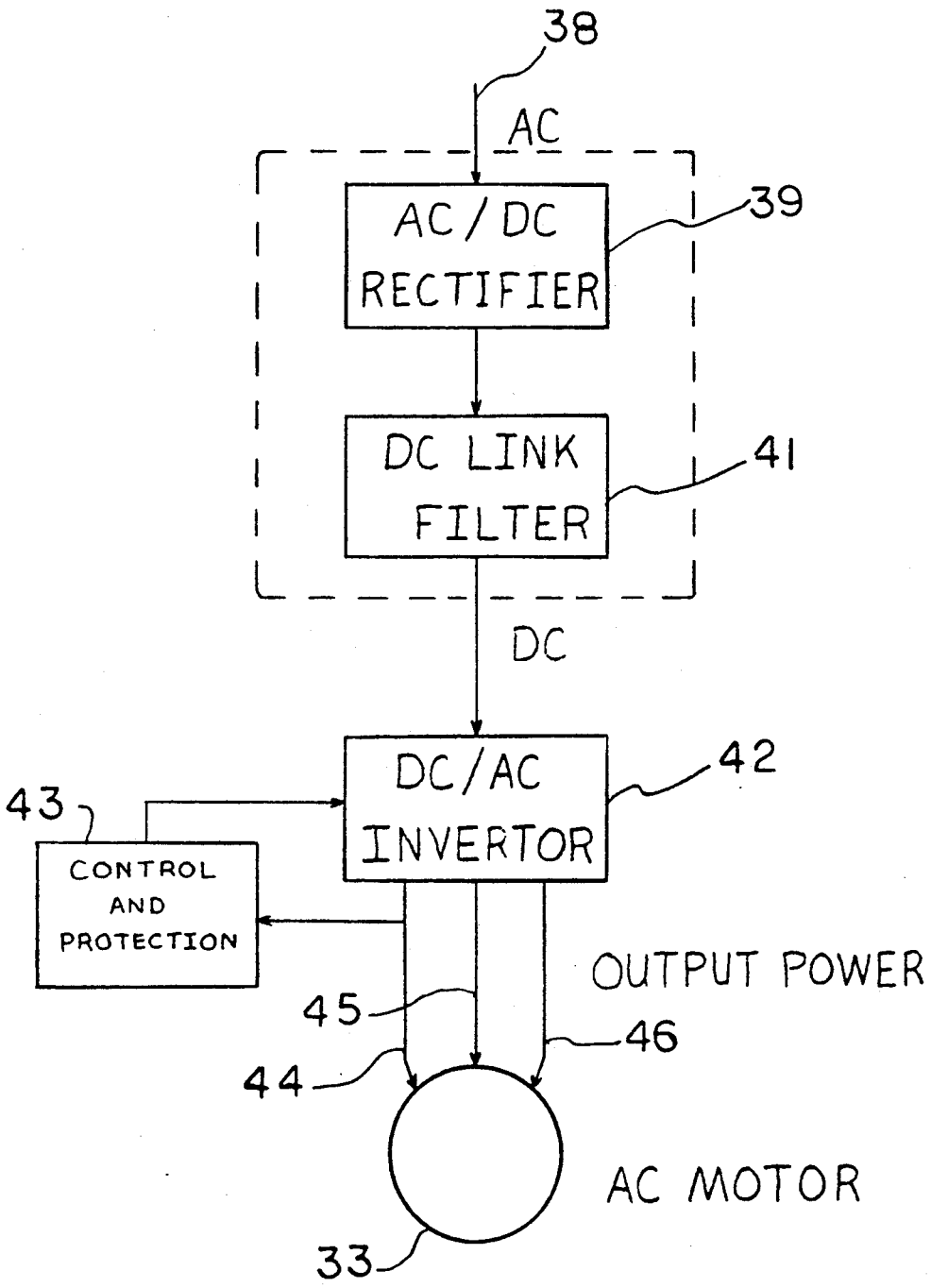
FIG. 5 is a schematic of a converter for converting D. C. current to three phase current.

In the alternative the single current supplied to the assembly 25 may be D. C. current. In this case D. C. current may be supplied by a generator or an A. C. source may be rectified to provide the D. C. current. As shown schematically in FIG. 5. a source of A. C. current 38 is connected to an A. C./D.C. rectifier 39 which is connected to a D. C. link filter 41 to provide a single D. C. current which is connected to the insulating collar 15 through line 19 (FIG. 1) and thence to the tubing 13b. The A. C./D, C. rectifier is a diode bridge that converts the incoming A. C. line voltage to a D. C. voltage. This circuit would include fuses and transient voltage protection circuits. A metal oxide varistor and a capacitor can be connected directly across the output of the bridge. The D. C. link filter consists of an inductance (choke) and capacitor for "smoothing" the rectified signal from the rectifier. Down hole the D. C. current is fed from connector 15a through conduit 29 to a D. C. / A. C. invertor 42 in assembly 25. The invertor is provided with control and protection as indicated at 43 and provides three phase current through conduits 44, 45 and 46 to motor 33. The D. C./A. C. invertor produces the three phase A. C. output at a specific or adjustable frequency. Typically the invertor circuit will include six Darlington transistors that switch on and off to allow the proper sequence of voltage pulses to propagate along the A. C. lines. The Control and Protection circuits provide the timing signals to the Darlington transistors and accepts inputs from the operator control elements, and feedback signals from the power circuits. As with the A. C. converter of FIG. 4 the FIG. 5 circuit is grounded to the casing by scratcher 18 and contact blocks 17. The equipment shown in FIG. 5 is commercially available and may be obtained from Eaton Drive division of Hammer Cutler, 3122 14th Ave, Kenosha, Wis. 53141 which sells the equipment under as model A F 505007-0480. This equipment is designed to convert three phase A. C. to D. C. and after the D.C. current is fed downhole convert the D. C. current to three phase A. C. current. The equipment will be suitably packaged to be run in a well.

In practicing the method of this invention with the equipment shown in FIG. 1 the well is completed by running in the tubing 13a–13b equipped with the insulating collars and the insulators 16 and supporting the assembly 25. The packer 26 may be carried on the tubing or the equipment may be landed in a previously run packer as will by apparent to those skilled in the art. After the tubing is landed in the wellhead 11 nonconducting fluid such as oil or gas may be pumped into the well through a port (not shown) in the wellhead connected to the casing-tubing annulus. This fluid will displace any conducting fluids in the casing-tubing annulus 47 and prevent shorting between the casing and tubing above the insulating collar 15a. If the well fluid level is below the packer the annulus will be clear of conducting fluids and displacement of will fluids will not be required. Thereafter A. C. or D. C. current may be provided to the assembly 25 through the casing and tubing and converted to three phase current to power the motor and centrifugal pump of assembly 25.

FIG. 2 shows a modified form of this invention is which a packer is not utilized. At an elevation above wells fluids in the casing conventional tubing 13a and 13b may be used. Beginning at least at an elevation above the well fluids an insulated tubing is used. As shown in FIG. 3 this tubing 13c includes conventional steel tubing 48 covered with insulating material 49. O-rings 51 may be provided between tubing sections to seal between the insulating material and prevent well fluids from reaching the steel tubing.

The steel tubing may be electrically connected to the well fluid lifting assembly 25 in any desired manner as indicated schematically by insulated conductor 52 extending between the lowest section of insulated tubing the assembly 25.

In the system of FIG. 2 a single phase A. C. or D. C. current is connected to the tubing and casing as hereinabove explained and three phase current supplied to the motor in assembly 25.

Figure 6:
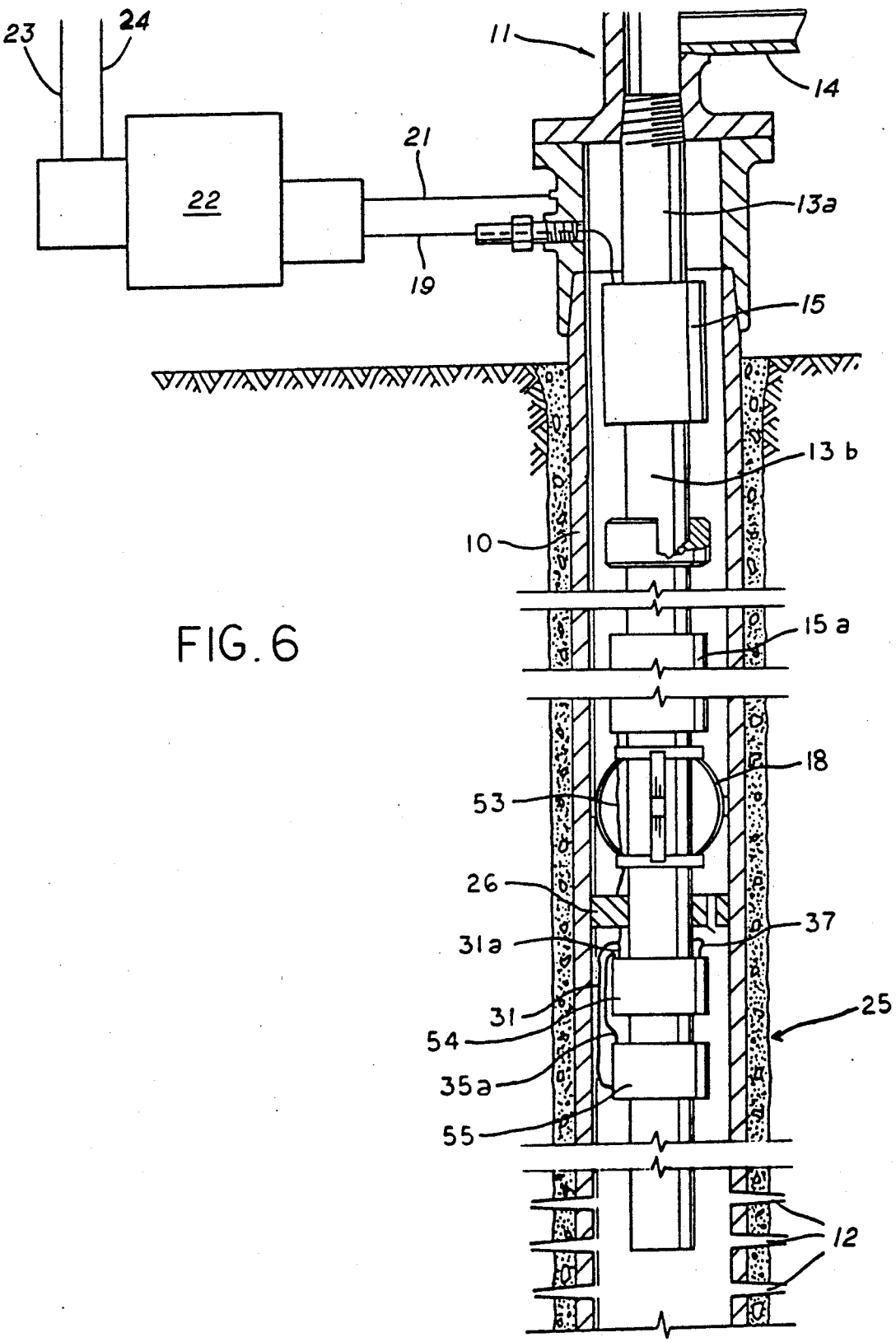
FIG. 6 is a view similar to FIG. 1 illustrating a modified form of this invention.

In FIG. 6 a form of the invention similar to that shown in FIG. 1 is shown. In this form of the invention the scratcher 18 is positioned above the packer 26. An insulated conductor 53 extends from the insulated collar 15a through the packer to the assembly 25. The pump and motor are shown at 54 and the FIG. 4 means for converting a single phase A. C. to three phase current is shown at 55. The system of FIG. 5 may be used to convert D. C. current to three phase current as disclosed hereinabove.

The foregoing disclosure and description of the invention are illustrative and explanatory thereof and various changes in the method and in the size, shape and materials, as well as in the details of the illustrated construction, may be made within the scope of the appended claims without departing from the spirit of the invention.

What is claimed is:

1. In a well having a casing containing formation fluid, an improved means for pumping the fluid to the surface, comprising in combination:

a centrifugal pump located within the well;

a submersible three-phase electrical motor located within the well and coupled to the pump for driving the pump;

means having a conductor, said means having a lower end connected to the motor and an upper end extending to the surface, said means having sufficient strength to support the weight of the pump and motor, allowing the pump and motor to be lowered into and retrieved from the well on said means;

means for supplying single-phase AC power from the surface down the conductor; and means located at the lower end of said means for converting the single phase AC power to three-phase electrical power to power the motor.

2. An improved method for pumping fluid from a well having a casing to the surface, comprising in combination:

lowering into the well on an electrical conductor means a three-phase electrical motor and centrifugal pump assembly;

providing single-phase electrical power down the conductor means, and converting at said assembly the single-phase electrical power to three-phase electrical power and powering the motor with the three-phase electrical power, causing the pump to rotate and pump the fluid to the surface.

3. In a well having a casing containing formation fluid, an improved means for pumping the fluid to the surface, comprising in combination:

a centrifugal pump located within the well;

a submersible three-phase electrical motor located within the well and coupled to the pump for driving the pump;

means including a production tubing providing an electrical conductor and insulation rings spaced along the tubing to electrically insulate the tubing from the casing, said means having a lower end connected to the motor and an upper end extending to the surface;

means for supplying a single electric current from the surface down the tubing; and means located at the lower end of said tubing for converting the single current to three-phase electrical current to power the motor including means connected to the casing which provides a ground.

4. The combination of claim 3 wherein the motor is insulated from the tubing by an insulating section in the tubing and a packer seals between the casing and tubing below the insulating section.

5. In a well having a casing containing formation fluid, an improved means for pumping the fluid to the surface, comprising in combination:

a centrifugal pump located within the well;

a submersible three-phase electrical motor located within the well and coupled to the pump for driving the pump;

means including a production tubing providing an electrical conductor and insulation means covering at least the lower section of the tubing to electrically insulate the tubing from the casing, said means having a lower end connected to the motor and an upper end extending to the surface;

means for supplying a single electric current from the surface down the tubing; and means located at the lower end of said tubing for converting the single current to three-phase electrical current to power the motor including means connected to the casing which provides a ground.

6. An improved method for pumping fluid from a well having a casing to the surface, comprising in combination:

lowering into the well on a tubing a three-phase electrical motor and centrifugal pump assembly;

providing a single electric current down the tubing, and converting at said assembly the single electric current to three-phase electrical current and powering the motor with the three-phase electrical power, causing the pump to rotate and pump the fluid to the surface.

7. The improved method of claim 6 wherein the annulus between the casing and tubing at a level below said assembly is packed off and well fluids in the annulus above said level are removed and replaced with a non-conducting medium.

8. The improved method of claim 6 wherein contact is established between the motor and the casing and the casing provides a ground.

9. The improved method of claim 6 wherein the tubing is covered with insulation material at least up to the level of well fluids in the well.

10. In a well having casing containing formation fluid, an improved means for pumping the fluid to the surface, comprising in combination:

a centrifugal pump located within the well;

a submersible three-phase electrical motor located within the well and coupled to the pump for driving the pump;

means having a conductor, said means having a lower end connected to the motor and an upper end extending to the surface, said means having sufficient strength to support the weight of the pump and motor, allowing the pump and motor to be lowered into and retrieved from the well on said means;

means for supplying single-phase AC power from the surface down the conductor with the casing serving as an electrical return;

phase converter means located at the lower end of the means having a conductor for converting the single-phase AC power to three-phase electrical power to power the motor; and means for providing a conductive path from the phase converter means to the casing to enable the casing to serve as the electrical return for the single-phase AC power.

* * * * *